United States Patent [19]

Islas

[11] 3,981,290

[45] Sept. 21, 1976

[54] COMPOUND BOW

[75] Inventor: John J. Islas, Canastota, N.Y.

[73] Assignee: Victor Comptometer Corporation, Chicago, Ill.

[22] Filed: Mar. 21, 1975

[21] Appl. No.: 560,581

[52] U.S. Cl. ..... 124/24 R; 124/86; 124/88

[51] Int. Cl.[2] ..... F41B 5/00

[58] Field of Search ..... 124/24 R, 23 R, 30 R, 124/25, 22

[56] References Cited

UNITED STATES PATENTS

| | | | |
|---|---|---|---|
| 3,674,001 | 7/1972 | Hitt | 124/24 R |
| 3,744,473 | 7/1973 | Nishioka | 124/30 R |
| 3,812,835 | 5/1974 | Smith | 124/24 R |

*Primary Examiner*—Richard C. Pinkham
*Assistant Examiner*—William R. Browne
*Attorney, Agent, or Firm*—Hamilton, Renner & Kenner

[57] ABSTRACT

An archery bow having a riser that is adapted to be grasped by an archer and which has a face and upper and lower, opposite end portions. The inboard ends of a pair of elongate spring members are mounted in cantilevered fashion from the face of the riser, one in association with each opposite end portion thereof. The medial portion of a limb member, in the fashion of a second degree lever, is pivotally mounted on the outboard end of each elongate spring member. A bow string extends between the outboard ends of the two limb members, and a cam follower is presented from the inboard end of each limb member to engage a corresponding cam secured to the face of the riser and which serves as a fulcrum against which the limb member acts to cock the spring member in response to the application of a drawing force to the bow string. The configuration of the cam determines the functional interrelation of the draw weight in response to the draw displacement of the bow string. Reeved pulleys are provided to synchronize movement of the limb members, and the spring members as well as the cams are preferably individually adjustable.

14 Claims, 10 Drawing Figures

COMPOUND BOW

BACKGROUND OF THE INVENTION

The present invention relates to an improved construction for a compound bow.

Historically, the force required to draw a bow progressively increased until it reached a maximum at full draw. Thus, an archer was required to expend the maximum effort to maintain the bow at full draw during the period of time required to effect final aim just prior to release.

A number of bow constructions have been advanced by which the draw weight peaks at a point prior to full draw and then reduces to a lesser value at full draw. This permits the archer to hold the bow at full draw with less physical strain. In addition, the flight characteristics of an arrow shot from such a bow are improved because the full magnitude of the impelling force is not applied to the arrow until after it begins its forward movement.

The earliest attempts to provide a compound bow appear to have employed eccentric cranks or pulleys mounted on the tips of the limbs. This unduly increased the mass and therefore the inertia of the limbs resulting in the necessity to greatly stiffen and shorten the limbs in order to reduce the distance through which the limbs tips were required to travel and thereby minimize the adverse effects of the increased mass and inertia. However, with the stiffness of the limbs being increased in conjunction with their being shortened, a complex bow string arrangement was required to provide the mechanical advantage necessary to draw the bow.

At least one variation of prior art compound bows employs a limb in the form of a first degree lever — each limb being secured to a handle, or center section (often designated as the riser) by virtue of a pivotal fulcrum. The outboard end of the limbs are joined by a bow string, and the inboard end of each limb engages a spring member that extends beyond the respective opposite ends of the handle section.

These prior known constructions are not only quite cumbersome but must usually be custom-made in order to provide the final draw weight desired by an archer for his particular draw length. The necessity for having to custom make such bows becomes more readily apparent when one appreciates that the draw length can vary as much as twelve inches from individual to individual depending upon each persons size and arm length.

SUMMARY OF THE INVENTION

It is, therefore, a primary object of the present invention to provide a new and useful compound bow.

It is another object of the present invention to provide a compound bow, as above, which can be adapted to have the draw weight peak at a selected draw displacement of the bow string.

It is still another object of the present invention to provide a compound bow, as above, which can be adapted to have the draw weight peak prior to full draw displacement and either remain the same, reduce as the draw continues beyond the peak to full draw or reduce to a predetermined value and maintain that value through the remainder of the draw.

It is yet another object of the present invention to provide a compound bow, as above, in which the peak draw weight can be readily varied.

It is a further object of the present invention to provide a compound bow, as above, in which the movement of the opposed limb members is fully synchronized.

It is a still further object of the present invention to provide a compound bow, as above, in which the full magnitude of the impelling force is not imparted to the arrow until after it has begun to move forwardly.

These and other objects, together with the advantages thereof over existing and prior art forms which will become apparent from the following specification, are accomplished by means hereinafter described and claimed.

In general, an archery bow embodying the concept of the present invention has a riser with a medial handle portion adapted to be grasped by an archer. The riser has a face and upper and lower, opposite ends. The inboard end of a first, leaf spring member is anchored to the face of the riser in spaced relation upwardly of the handle, and the inboard end of a second, leaf spring member, preferably identical to the first spring member, is anchored to the face of the riser in spaced relation downwardly of the handle. The first and second spring members are the primary means for storing and releasing the energy used to propel an arrow.

The outboard end of each spring member is pivotally attached to the medial portion of a corresponding limb member which acts as a second degree lever to cock the respective leaf spring. The inboard end of each limb member presents a follower that engages a corresponding cam on the riser whereby to form a fulcrum by which the application of a drawing force to said bow string cocks the spring member. The limb members themselves may flex as the bow is drawn, thereby to store additional energy for propelling an arrow. However, adjustment of the cams — their configuration and disposition — and selective prestressing of the spring members accomplish more predictable results when the limb members are substantially rigid so as to act for the most part solely as lever members. In any event, the outboard end of the two limb members each present the customary notches between which the bow string extends.

The configuration of the cam surfaces is selected to provide the desired draw weight to bow string draw displacement.

A continuous cable is reaved in a cross-over pattern between sheaves located at opposite ends of the riser. The inboard ends of the limb members are operatively secured to the sheaves and/or cable runs in order for the cable to synchronize the movement of the two limb members such that they always move in mirrored unison.

One preferred embodiment of a compound archery bow incorporating the concept of the present invention is shown by way of example in the accompanying drawings and described in detail without attempting to show all of the various forms and modifications in which the invention might be embodied; the invention being measured by the appended claims and not by the details of the specification.

DESCRIPTION OF A PREFERRED EMBODIMENT

Figure 1:
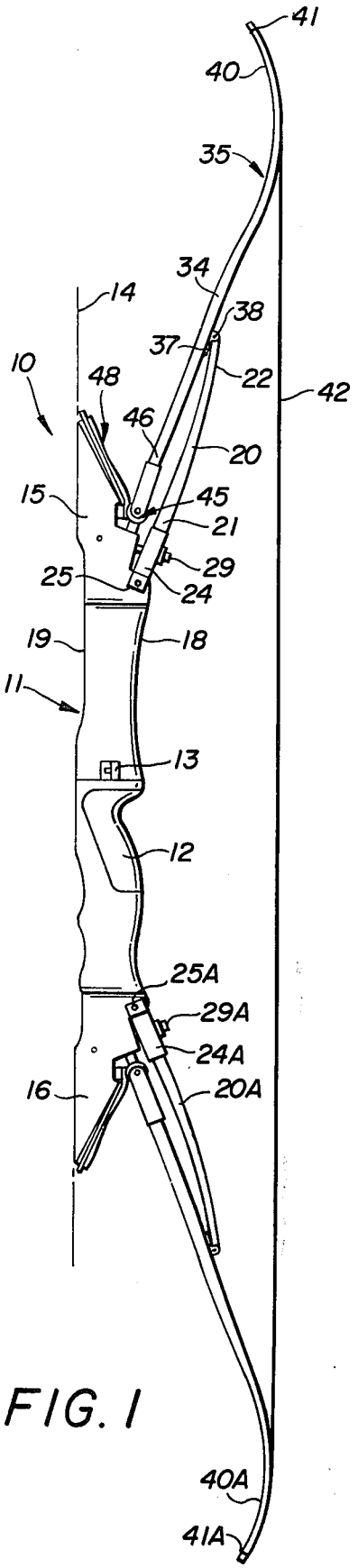
FIG. 1 is a side elevation of a bow embodying the concept of the present invention.
Figure 2:
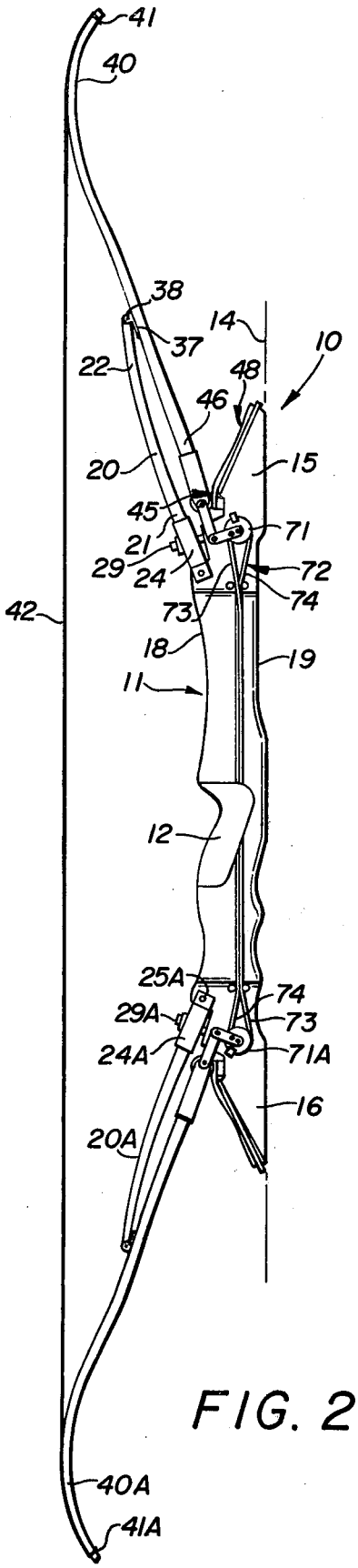
FIG. 2 is an opposite side elevation of the bow depicted in FIG. 1.
Figure 3:
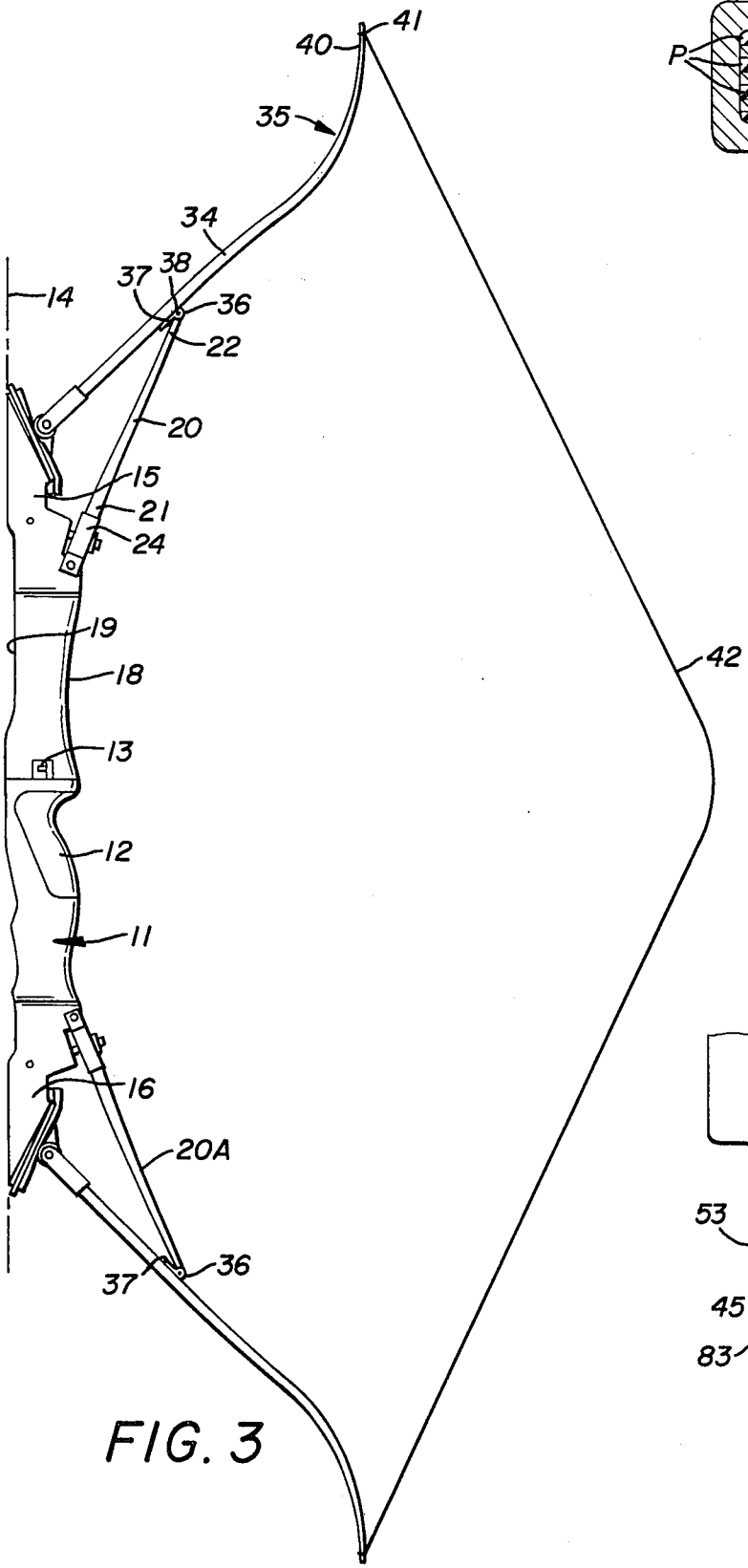
FIG. 3 is a side elevation similar to FIG. 1 except that the bow is depicted at full draw.

An archery bow embodying the concept of the present invention is designated generally by the numeral 10 on the attached drawings. The bow 10 utilizes a riser, or center section, 11 on which is provided a conventional handle 12 and arrow rest 13 (FIG. 1). For purposes of orientation in the description hereinafter set forth, the bow 10 will be presumed to be disposed in a normal shooting position — i.e., with the axis 14 of the riser 11 being vertically disposed. As such, the riser has: upper and lower end portions 15 and 16, respectively; a face 18 that is directed toward the archer holding the bow; and, a back 19 that is directed toward the target.

The upper and lower end portions 15 and 16 are, except for their orientation, virtually identical. In order, therefore, to minimize reduplication the following description will detail only the upper half of the bow 10, it being understood that the same description is equally applicable to the lower half thereof. Accordingly, as to any component on, or in, the lower portion of the bow the identifying numeral therefor shall be identical to the numeral employed to designate the corresponding component on the upper half of the bow with the addition that as applied to the lower portion of the bow such number will be used in conjunction with the letter A appearing as a suffix.

A pair of leaf springs 20 and 20A comprise the primary energy storing members of the bow 10. Spring 20 is mounted to the upper end portion 15 of the riser 11 in cantilevered fashion. That is, the inboard end 21 of the spring 20 is secured to the upper end portion 15 allowing the outboard end 22 of the spring 20 to be displaced in response to flexure of the spring 20.

A bow embodying the concept of the present invention will achieve its basic objective irrespective of whether the interconnection between the spring 20 and the riser 11 is fixed or selectively variable. Nevertheless, when the connection is selectively variable the bow may be more widely, and more critically, adjustable. Although a wide variety of means may be employed to secure the power element, or spring, 20 to the riser 11, the inboard end 22 of the spring 20 may be securedly encased within a socket 23 in one end of a mounting block 24, as perhaps best seen in FIGS. 4 and 5. This mounting block 24 is pivotally supported on the riser 11 by a pivot pin 25 that extends transversely through the riser 11 and the clevis lugs 26 and 27 presented to extend downwardly from the mounting block 24 in a direction opposite to the spring 20.

The shank 28 of an adjusting bolt 29 extends through registered slots 30 and 31 in the mounting block and spring, respectively, and is anchored in a threaded bore 32 in the riser 11.

Figure 7:
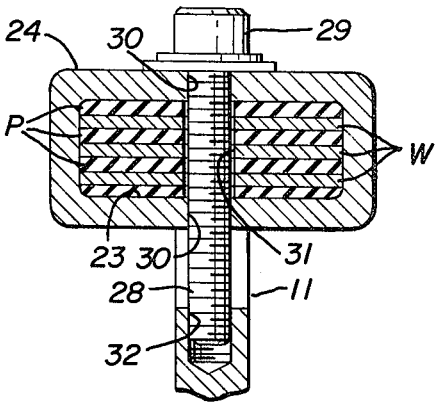
FIG. 7 is a cross section taken substantially along line 7—7 of FIG. 5 and appearing on the same sheet of drawings as FIG. 3.

The spring 20 may be fabricated from a single material or composite plurality of materials. As an example of the latter, and as best seen in FIG. 7, the spring 20 may well comprise a composite plurality of layers P and W, respectively. The layers are represented as being plastic and wood in the drawings, but steel and/or other materials may be employed for one or more layers, as desired. Selectively tightening, or loosening, the adjusting bolts 29 and 29A will vary the draw weight of the bow, as will be hereinafter more fully explained.

The outboard end 22 of the spring 20 is pivotally secured to the medial portion 34 of a limb element 35, as by a wide-mouthed clevis 36 secured to the outboard end 22 which receives a pivot pin 38 extending through the elongated eye 39 fastened to the medial portion 34 of the limb element 35. The limb element 35 may, as shown, be a recurved section, and the elongated eye 39 may be presented from a bracket 37 that is positionable at selective locations along the limb element 35 to afford additional means by which to effect adjustability of the bow 10.

The outboard end 40 of the limb element 35 is provided with a notch 41, and a bow string 42 engages and extends between the notches 41 and 41A in the upper and lower limb elements 35 and 35A, respectively.

Figure 6:
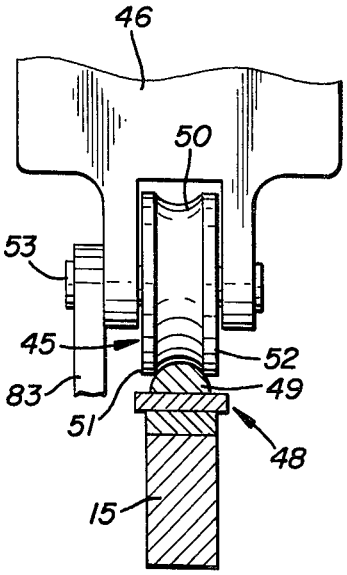
FIG. 6 is a cross section taken substantially along line 6—6 of FIG. 5 and appearing on the same sheet of drawings as FIG. 3.

A follower 45 is presented from the inboard end of 46 of the limb element 35. The follower 45 engages a cam 48 presented from the face 18 of the riser 11 in closer proximity to the upper terminus of the upper portion 15 than the pivotal connection of the mounting block 24 to the riser 11. The cam 48 is substantially vertically oriented and is provided with a guide rib 49 (FIG. 6) that extends along the length thereof. By employing a roller 50 having flanges 51 and 52 on the rim thereof to serve as the follower 45, by having the flanges 51 and 52 embracingly engage the guide rib 49, by rotatably mounting the roller 50 on a pin 53 supported on the inboard end 46 of the limb element 35 and by orienting the guide rib 49 transversely with respect to pivot pin 38, the lateral stability of the limb element 35 as well as its resistance to twisting under load is considerably enhanced.

Once a person skilled in this art comprehends the basic concept to which the present invention is directed, he may conceive a multitude of configurations for the cam 48, each to provide a particular functional relationship between the draw displacement and draw weight. Without, therefore, being limited to a particular cam configuration, that configuration depicted in FIGS. 4, 5 and 8, has a range R along which the follower 45 moves at a draw force is applied to the bow string 42. The range R may be divided into at least a first and, if desired, second portion $R_1$ and $R_2$, respectively, as shown. The disposition, and configuration, of portions $R_1$ and $R_2$ in the exemplary bow largely determine the interrelation of the draw weight to draw displacement.

In the preferred embodiment of the bow depicted, the portion $R_1$ of the range R has a fairly flat configuration and is disposed substantially parallel to the axis of the riser 11. Portion $R_2$, however, has a very gently curving, concave configuration that is disposed at an inclination of between approximately 15° to 30° with respect to portion $R_1$. For the purpose of having a convenient reference, the slope of the concave portion $R_2$ will be termed as being "negative." In portion $R_3$, sequentially following after portion $R_2$, the cam 44 reverses the direction of its concave slope, and that slope is designated as being "positive."

Figure 4:
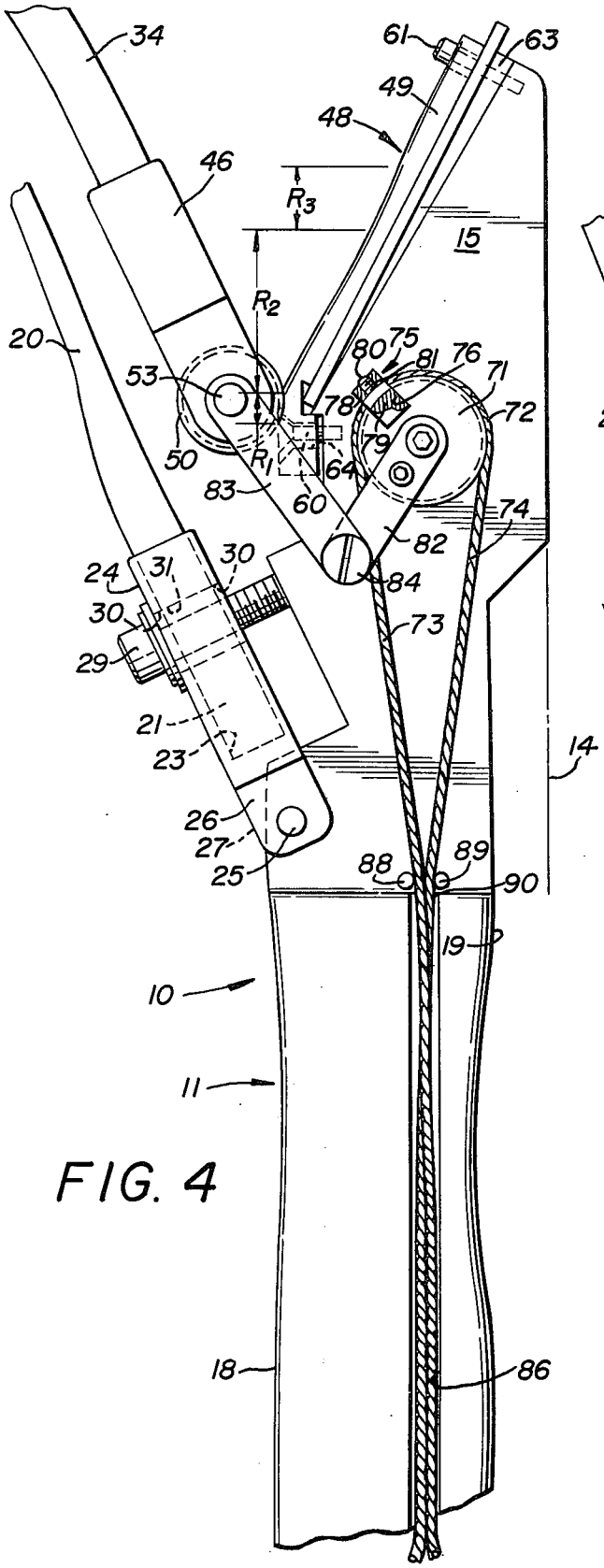
FIG. 4 is an enlarged area of FIG. 2 with the components depicted in the position they would normally assume when the bow is strung but not drawn.
Figure 5:
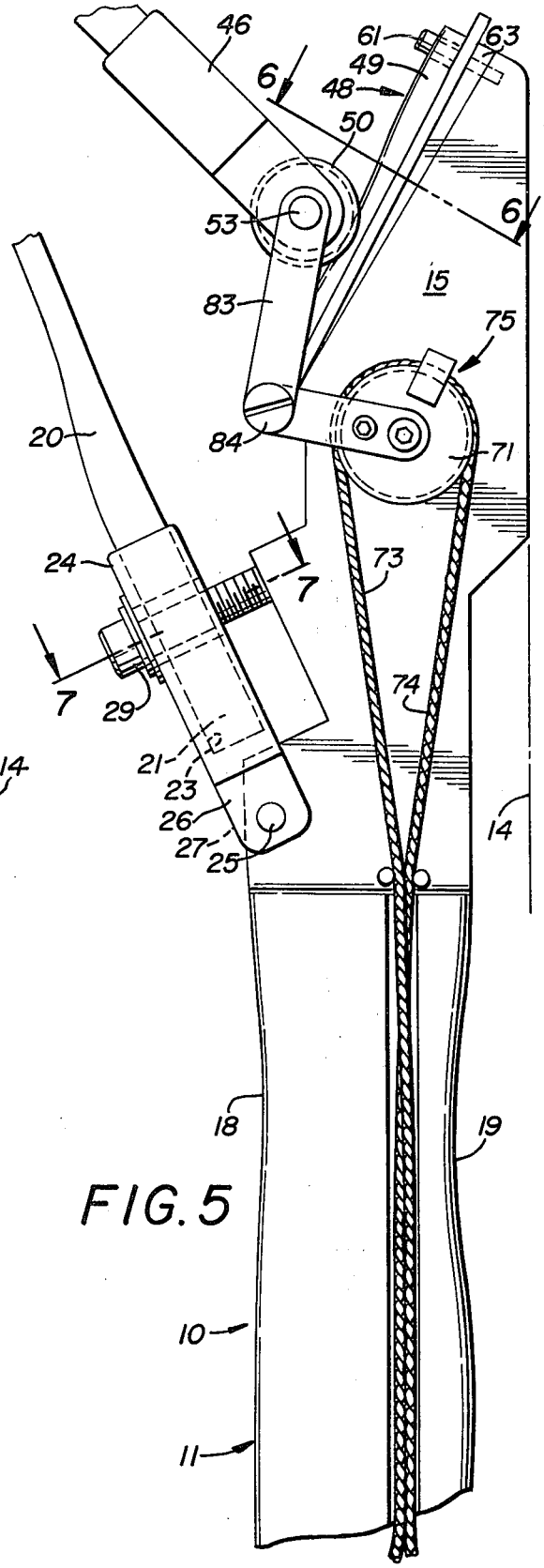
FIG. 5 is a view similar to FIG. 4 but with the components disposed in the position they would normally assume when the bow is at least substantially at full draw.
Figure 8:
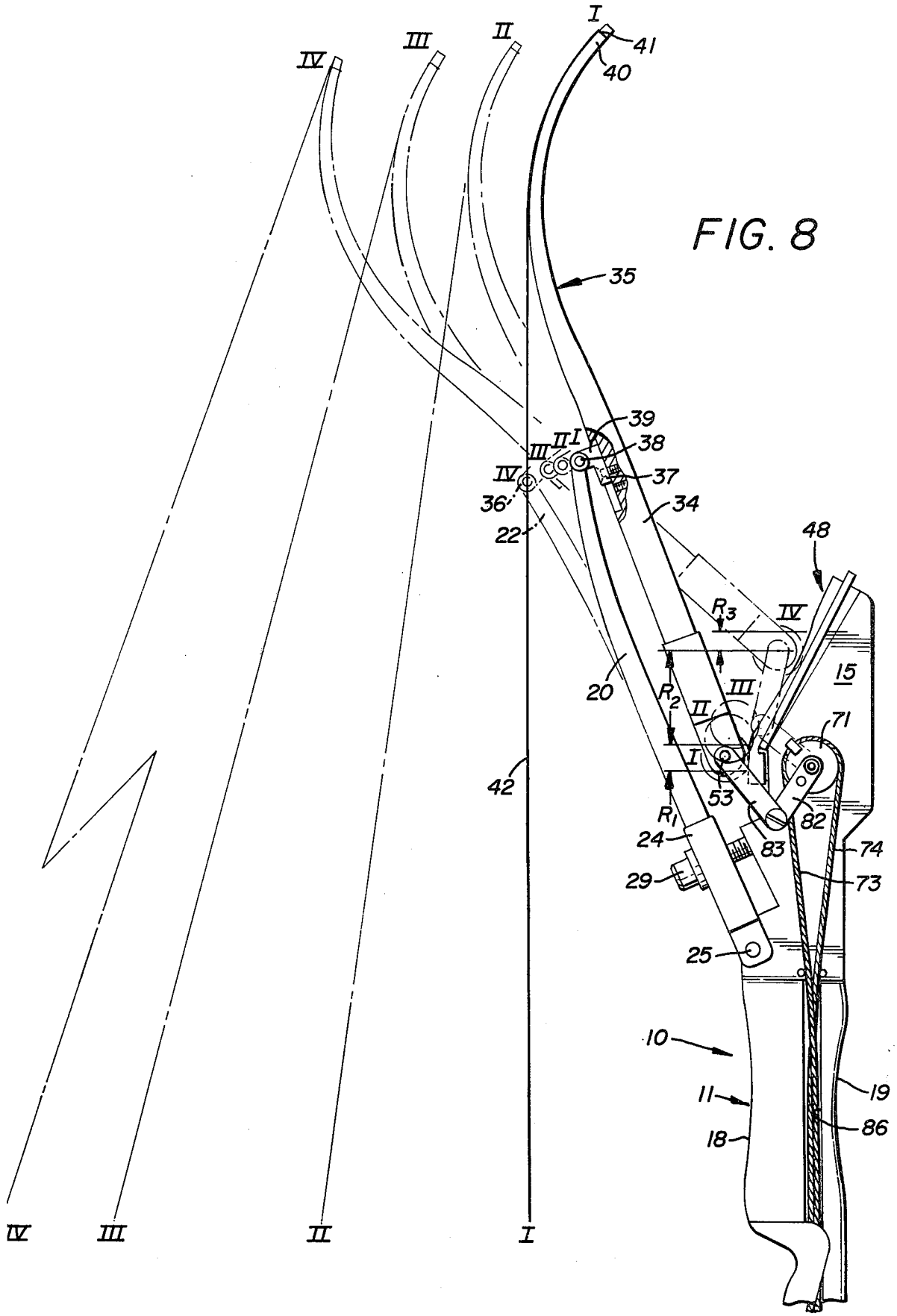
FIG. 8 is an enlarged side elevation of the upper portion of the bow depicted in FIG. 2 and depicting the sequential disposition of the components as the bow is progressively drawn.
Figure 9:
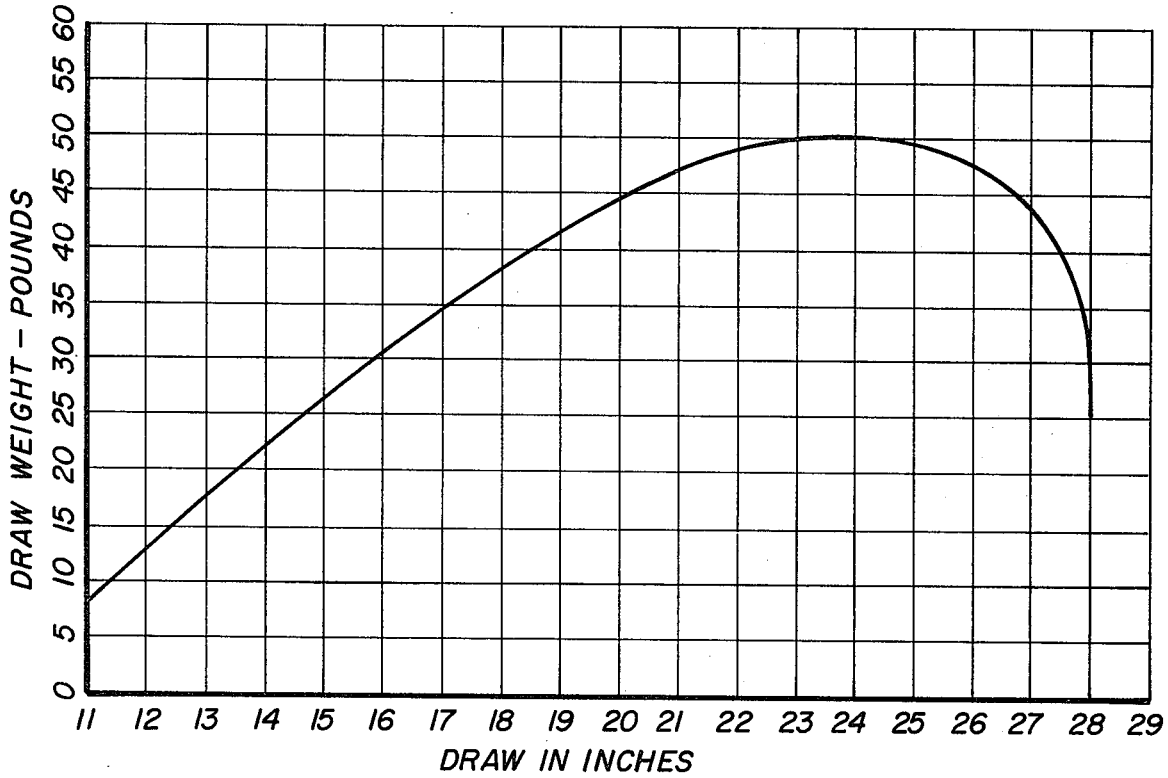
FIG. 9 is a graphical representation of the relationship between the draw weight and draw displacement for the bow depicted in FIGS. 1 through 8, herein; and, FIG. 10 depicts representative draw weight/draw displacement curves available by selectively varying the configuration and/or disposition of the cams employed in a bow embodying the concept of the present invention.

FIG. 9 graphically represents the draw weight relative to the draw displacement achieved by a bow having the cam configuration and disposition depicted in FIGS. 4 and 5, and FIG. 8 depicts the sequential disposition of the bow 10, and its component parts, as that bow is drawn. The exemplary bow from which the results depicted in FIG. 9 were obtained has a peak draw weight of approximately 50 pounds and a normal string brace of approximately 9 inches. The bow was drawn as though being used with an arrow having a draw length of 28 inches.

During the first 6 inches of draw displacement beyond the brace, the draw weight increased fairly steadily to approximately 26 pounds. During this initial phase of the draw the entire limb element 35 pivots about the follower 45 as the spring 20 begins to cock. The flexure of the spring 20 is measured by the displacement of the pin 38 as it moves from position I to position II (FIG. 8). In applying the cocking force to spring 20 the lever-like element 35 acts by virtue of a displacing fulcrum, as denoted by movement of pin 53 from position I to position II. The follower 45 accomplishes this change in position of pin 53 by rolling along range $R_1$ from the position I to the position II.

During the next, or second, successive 6 inch draw displacement the draw weight again increases relatively steadily to approximately 47 pounds (FIG. 9). During this phase of the draw the entire limb element 35 continues to pivot about the follower 45 as the spring 20 is further cocked. This continued flexure of the spring 20 is reflected by a further translation of pin 38 from position II to position III, and continued movement of the follower is reflected by movement of the pin 53 from its position II to position III.

The next, or third, successive 6 inch increment of draw displacement for the exemplary bow depicted herein takes the bow past its peak draw weight and begins the reduction thereof accomplished at full draw. It is during this draw increment that the follower 45 moves along substantially the full portion $R_2$ of the cam 48.

During approximately the first quarter of the third successive 6 inch draw displacement the draw weight continues to increase, albeit at a somewhat slower rate. Although the spring 20 continues to receive and store energy throughout the entire draw as a result of the continued flexure thereof evidenced by the continued translation of pin 38, the draw weight begins to be effected by the compound effect of the increased mechanical advantage achieved by the ever increasing angle at which the bow string 42 applies force to the lever-like limb element 35 as it continues to cock spring 20 and the favorably changing location of the fulcrum achieved as the follower 45 moves along the negatively inclined portion $R_2$ of the cam 48.

During approximately the next 50 percent of the third incremental 6 inch draw displacement the increased mechanical advantage, the orientation of the lever-like limb element 35 with respect to the riser 11 and the movement of the follower 45 along portion $R_2$ of cam 48 combine to maintain a relatively constant peak draw weight of approximately 50 pounds.

During the last quarter of the third incremental 6 inch draw displacement these factors become increasingly more favorable so that by the time the various components reach their respective positions designated at IV the draw weight begins to decline with increased displacement — at 27 inches of draw displacement the draw weight has dropped to 44 pounds. The continued favorable effect of those factors continues beyond position IV to full draw. As shown in FIG. 9, the draw weight will drop to approximately 30 pounds during the next one inch of draw displacement — i.e., at 28 inches of total draw displacement.

Figure 10:
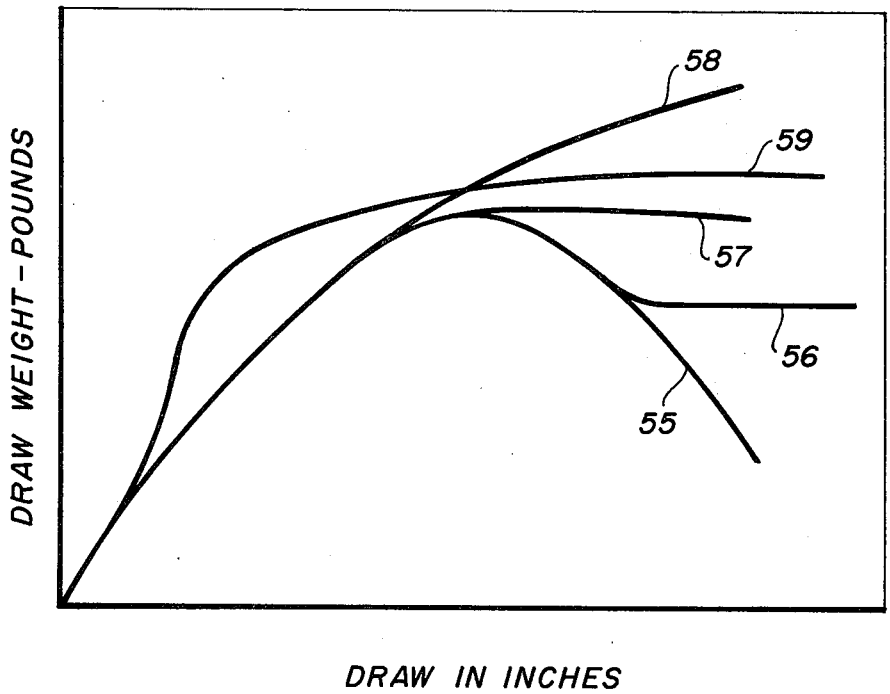

It should now be appreciated that by varying the disposition and/or configuration of the cam 48 one can vary the draw weight to draw displacement curve. In fact, a change in the disposition and/or configuration of cam 48 can vary that curve from the curve 55 in FIG. 10 (which generally reflects the type curve delineated in FIG. 9) to curve 56, wherein the draw weight levels off at a draw weight below the peak, to, for example, curve 57 where the peak draw weight is maintained throughout a predetermined range of final draw displacement. A change in the disposition and/or configuration of the cam 48 can also effect a curve 58 which resembles a non-compound bow wherein the draw weight continues to increase in response to continued draw displacement.

In order to avail oneself of these selections it is at least desirable that the cams 48 and 48A be removably mounted on the riser 11. To effect this result the cam may be secured by a pair of screws 60 and 61, one at each end of the cam 48. In this way cams which produce desired draw-to-displacement curves can be freely interchanged. In addition, shims, such as 63, may be interposed between the cams 48 and the riser 11 to vary the disposition of any given cam. And, by having the securing screw 60 extend through an elongate slot 64 in the cam, one can effect a translatory displacement of any given cam 48 with respect to the vertical axis 14 of the riser 11.

In addition to controlling the draw weight to displacement curve at and after the peak draw weight has been achieved, the configuration and disposition of the curve can also be selected to determine the shape of the curve prior to the peak draw weight. For example, one may wish to increase the rate at which the draw weight increases in response to draw displacement near the beginning of the draw (curve 59 in FIG. 10). In this way the work required to draw the arrow is increased abruptly at the beginning of the draw displacement (the work done to draw the arrow to any given displacement being equal to the area beneath the draw weight/draw displacement curve to that point along the abscissa representing the given displacement).

At full draw the potential energy available to drive the arrow is substantially equal to the work having been done to draw the bow. However, tests have shown that with the initial slope of the draw weight/draw displacement curve being substantially equivalent to that depicted in curves 55 through 58 of FIG. 10 the string exerts very little, if any, additional impetus to the arrow as the string approaches its brace position. However, by selecting a cam configuration and/or disposition to provide an initial slope to the draw weight/draw displacement curve as generally depicted by curve 59 in FIG. 10, the string can continue to impart its energy to the arrow through a longer range.

Although curve 59 is depicted as paralleling curve 57 through the final range of draw displacement, it should be appreciated that any desired curve within the concept of the present invention can be achieved at and after peak draw weight by selection of the configuration and/or disposition of the appropriate portion of the cam.

In combination with the selection of a particular cam 48, a prestressing of the spring 20 is also generally required to effect fine tuning of the draw weight. This is accomplished by selectively tightening or loosening the adjusting bolt 29.

The controlled prestressing of the spring 20 available by tightening or loosening the adjusting bolt 29 is useful not only in providing a control for changing the magnitude of the bow draw weight (a wide variation of the draw weight can be achieved through manipulation of the adjusting bolt 29) but also in order to accommodate any idiosyncracies a particular archer might have that would require selectively varying the relative draw strengths of the upper and lower springs 20 and 20A. This, too, can readily be effected by selectively tightening or loosening the adjusting bolts 29 and/or 29A.

Particularly with a compound bow it is highly desirable that the upper and lower limb elements 35 and 35A operate in mirrored unison. This synchronization can be readily achieved by mounting upper and lower sheaves 71 and 71A on the opposite end portions of the riser 11. A continuous cable 72 is reaved between the two sheaves 71 and 71A in a cross over pattern.

Depending upon the exact location of the sheaves 71 and 71A, a variety to means may be employed operatively to effect a connection between the control cable 72 and the limb elements 35 and 35A. If, for example, the sheaves are located so as to be in closer proximity to the ends of the riser 11 than the position ever achieved by the inboard ends 46 and 46A of the limb elements 35 and 35A, one run 73 of the cable 72 may be secured directly to the inboard end 46 of limb element 35 and the other run 74 may be secured directly to the inboard end 46A of limb element 35A.

However, one might normally prefer not to locate the sheaves in such close proximity to the ends of the riser where they would be so vulnerable to damage. In that event the sheaves may be rotatably mounted on the riser 11 in proximity to the inboard ends of the limb elements. As best seen in FIG. 4, the cable 72 is then secured to the sheave 71 by a C-shaped block 75 that is received within a radially oriented slot 76 in the sheave. The cable 72 is received in the bight between the opposed jaws 78 and 79 of the block 75, and a set screw 80 threadably received in the bore 81 extending through jaw 78 can be used to clamp the cable 72 against the opposite jaw 79.

A crank arm 82 is rigidly secured to the sheave 71 and a link 83 is pivotally connected between the radially outer end of crank arm 82 and the inboard end 46 of the limb element 35, as by pivot pins 84 and 53.

In order to enhance the aesthetic appearance of the bow 10, it may be desirable to confine the opposed runs

73 and 74 of cable 72 within a channel 86 provided along the medial extent of the riser 11. A pair of turning pins 88 and 89 are provided in proximity to the mouth 90 of the channel 86 in order to reduce frictional resistance. As shown, the runs 73 and 74 may cross within the channel 86.

It should now be apparent that the concept of the present invention provides a compound bow with the capability of facile adjustability to accommodate the personal whims and idiosyncracies of various archers and otherwise accomplishes the objects of the invention.

What is claimed is:

1. An archery bow comprising: a riser having a face and opposite, upper and lower ends; a handle presented from said riser medially the upper and lower ends thereof; upper and lower cams presented from the face of said riser, one in proximity to each corresponding end thereof; upper and lower, elongate spring members, each having an inboard and an outboard end; the inboard end of each said spring member being secured to the face of said riser, one between the handle and each cam; upper and lower limb elements each having an inboard and an outboard end; a cam follower presented from the inboard end of each limb element; a string notch provided in the outboard end of each limb element; the outboard end of each spring member being pivotally attached to the medial portion of the corresponding upper and lower limb elements with the cam followers engaging the corresponding cams; and, a bow string extending between said notches.

2. An archery bow, as set forth in claim 1, in which said cams comprise: a surface along which said follower moves during the draw of said bow; and, means to select the disposition of said cam surface.

3. An archery bow, as set forth in claim 1, in which said cams comprise: a surface along which said follower moves during the draw of said bow; and, means removably to mount the cams on the face of said riser.

4. An archery bow, as set forth in claim 1, in which each said cam comprises: a surface having a range along which said follower moves as a draw force is applied to said bow string; said range being divided into one or more portions; the configuration of said first portion determining the interrelation of the draw weight to the draw displacement prior to the peak draw weight; the configuration of said second portion determining the interrelation of the draw weight to the draw displacement subsequent to the peak draw weight.

5. An archery bow, as set forth in claim 4, in which said cam surface is further provided with a third portion to be engaged by said follower sequentially after said second portion; the configuration of said third portion determining the interrelation of the draw weight to the draw displacement at full draw.

6. An archery bow, as set forth in claim 1, in which said cam surfaces each present a guide rib and said followers each comprise roller means; flanged rims embracingly maintaining contact between said roller means and its corresponding guide rib.

7. An archery bow, as set forth in claim 1, in which the outboard end portion of each limb element presents a substantially rigid recurve.

8. An archery bow, as set forth in claim 1, in which means are provided selectively to pivot said spring members with respect to said riser and thereby adjust the prestress loading of said spring members.

9. An archery bow, as set forth in claim 1, in which a sheave is rotatably mounted on each opposite end portion of said riser; a continuous cable being reaved between said opposed sheaves to present a first and second run; said runs delineating a cross over pattern; means operatively interconnecting the inboard end of said upper limb element to said first run; and, means operatively interconnecting the inboard end of said lower limb element to said second run.

10. An archery bow comprising: a riser adapted to be grasped by an archer and having opposite, upper and lower portions; fulcrum means secured to said upper and lower portions of said riser; an elongate spring member mounted in cantilevered fashion from each said opposite portion of said riser; an upper and a lower limb element, each having an inboard end portion, a medial portion and an outboard end portion; a bow string extending between the outboard end portions of said limb elements; follower means presented from the inboard end portions of said upper and lower limb elements having a translational engagement with the fulcrum means presented from the corresponding upper and lower portions of said riser for supporting each limb element when pivoted during a cocking action; the medial portion of each said upper and lower limb elements engaging corresponding elongate spring members to cock the latter in response to the application of the drawing force to said bow string whereby the inboard end portion, the medial portion and the outboard end portion of said limb elements are interconnected with the remainder of said bow such that the limb elements each function as a second degree lever arm.

11. An archery bow, as set forth in claim 10, in which said follower means presented from the inboard end portion of said limb elements comprises: a cam follower; and, in which said fulcrum means presented from the upper and lower portions of said riser comprise a cam surface on the corresponding upper and lower portions of said riser, said cam surface being engaged by said follower means on the corresponding upper and lower limb elements.

12. An archery bow, as set forth in claim 11, in which said cam surfaces each have a range along which the corresponding follower moves as force is applied to draw said bow string; each said cam surface range being divided into one or more portions; said followers moving along said first portion to require a progressively increasing force to draw said bow string; said followers moving along said second portion after a predetermined draw displacement to effect a reduction in the force required to draw said bow string through its remaining draw displacement.

13. An archery bow, as set forth in claim 12, in which means are provided to secure selected cam surfaces to said riser; and, means are also provided selectively to adjust the position of said cam surfaces with respect to said riser.

14. An archery bow comprising: a riser member adapted to be grasped by an archer and having opposite, upper and lower portions; an elongate spring member mounted in cantilever fashion from each opposite portion of said riser member; a cam presented from each opposite portion of said riser member outwardly of the spring member mounted thereon; a limb member mounted on each spring member; a bow string presented from said limb members; a cam follower presented from each limb member to engage the corresponding cam on said riser element whereby to form a fulcrum by which the application of a drawing force to said bow string cocks said spring member.

* * * * *